US012612223B1

(12) United States Patent
Jacob et al.

(10) Patent No.: US 12,612,223 B1
(45) Date of Patent: Apr. 28, 2026

(54) LID SYSTEM FOR BEVERAGE CONTAINER

(71) Applicant: Brumate, Inc., Denver, CO (US)

(72) Inventors: Dylan M. Jacob, Denver, CO (US); Jordan Westerberg, Denver, CO (US)

(73) Assignee: Brumate, LLC, Denver, CO (US)

( * ) Notice: Subject to any disclaimer, the term of this patent is extended or adjusted under 35 U.S.C. 154(b) by 0 days.

(21) Appl. No.: 19/269,930

(22) Filed: Jul. 15, 2025

(51) Int. Cl.

| | |
|---|---|
| ***B65D 47/20*** | (2006.01) |
| ***A47G 19/22*** | (2006.01) |
| ***B65D 25/28*** | (2006.01) |
| ***B65D 47/30*** | (2006.01) |
| ***B65D 47/32*** | (2006.01) |

(52) U.S. Cl.
CPC ..... *B65D 47/2043* (2013.01); *A47G 19/2272* (2013.01); *B65D 25/2811* (2013.01); *B65D 47/305* (2013.01); *B65D 47/32* (2013.01)

(58) Field of Classification Search
CPC ..... B65D 47/2043; B65D 25/2811; B65D 47/32; B65D 47/305; A47G 19/2272
See application file for complete search history.

(56) References Cited

U.S. PATENT DOCUMENTS

| | | | | |
|---|---|---|---|---|
| 4,057,167 | A | 11/1977 | Lee | |
| 4,819,829 | A | 4/1989 | Rosten et al. | |
| 5,873,478 | A | 2/1999 | Sullivan et al. | |
| 6,752,287 | B1 | 6/2004 | Lin | |
| 7,513,380 | B2 | 4/2009 | Canedo | |
| 7,845,510 | B2 | 12/2010 | Schmidtner et al. | |
| 8,376,173 | B2 | 2/2013 | Britto et al. | |
| D686,448 | S | 7/2013 | Boroski | |
| 8,602,238 | B2 * | 12/2013 | El-Saden | B65D 47/065 215/389 |
| 8,668,106 | B1 | 3/2014 | Joy et al. | |
| D729,569 | S | 5/2015 | Herbst et al. | |
| 9,351,597 | B2 | 5/2016 | Liu et al. | |
| 9,617,046 | B1 | 4/2017 | Sato | |
| 10,086,982 | B2 | 10/2018 | Bristow | |
| 10,159,368 | B2 | 12/2018 | Lin | |
| 10,390,643 | B2 | 8/2019 | Anderl | |
| 10,687,643 | B2 | 6/2020 | Cheng | |

(Continued)

FOREIGN PATENT DOCUMENTS

| | | |
|---|---|---|
| BR | 202015032688-8 Y1 | 7/2020 |
| CN | 213993164 U | 8/2021 |

(Continued)

*Primary Examiner* — James N Smalley
(74) *Attorney, Agent, or Firm* — SHOOK, HARDY & BACON L.L.P.

(57) ABSTRACT

A lid system for a beverage container is disclosed that improves hygiene and ease of use by integrating a hands-free, self-deploying straw mechanism. The lid body includes a slidable cover that moves along a recessed channel between open and closed positions. Beneath the cover, a cavity houses a straw assembly including a pivotable spout and removable straw portion. As the lid cover is slid open, a spring-biased mechanism automatically pivots the spout from a stowed position to a deployed position aligned with a central fluid outlet. Magnetic elements may assist actuation of the lid cover, enabling one-handed operation and minimizing contact with fluid-path components. When closed, the lid cover conceals and seals the spout and air vent to prevent contamination and leakage.

18 Claims, 10 Drawing Sheets

(56) References Cited

U.S. PATENT DOCUMENTS

| | | | |
|---|---|---|---|
| 10,858,158 | B2 | 12/2020 | Cheng |
| 10,870,522 | B2 | 12/2020 | Lane |
| 11,077,995 | B2 | 8/2021 | Pinelli et al. |
| 11,247,818 | B1 | 2/2022 | Lewandowski et al. |
| 11,358,760 | B2 | 6/2022 | McNamara et al. |
| 11,358,762 | B2 | 6/2022 | Harris et al. |
| 11,365,033 | B2 | 6/2022 | Berresheim |
| 11,390,432 | B2 | 7/2022 | Li et al. |
| 11,447,309 | B2 | 9/2022 | Jinkins et al. |
| 11,697,532 | B1 | 7/2023 | Cheng |
| 11,814,212 | B2 | 11/2023 | Oakes |
| 11,851,250 | B2 | 12/2023 | Choi et al. |
| 11,918,130 | B2 | 3/2024 | Burden |
| 11,939,116 | B2 | 3/2024 | Polt |
| 12,012,258 | B2 | 6/2024 | Lewandowski et al. |
| 12,012,264 | B2 | 6/2024 | Hofmann et al. |
| 12,103,740 | B2 | 10/2024 | Harris et al. |
| 12,239,251 | B2 | 3/2025 | Meyers et al. |
| 12,246,886 | B2 | 3/2025 | Li |
| 12,268,315 | B2 | 4/2025 | Jacob |
| 12,384,613 | B2 | 8/2025 | Jacob |
| 12,420,993 | B2 | 9/2025 | Lin |
| 2010/0181329 | A1 | 7/2010 | Davies et al. |
| 2015/0164254 | A1 | 6/2015 | Niedens |
| 2016/0150898 | A1 | 6/2016 | Hoskins |
| 2016/0272384 | A1 | 9/2016 | Lee et al. |
| 2017/0066573 | A1 | 3/2017 | Karussi et al. |
| 2018/0050850 | A1 | 2/2018 | Murosky et al. |
| 2019/0263572 | A1 | 8/2019 | Keung |
| 2020/0352368 | A1 | 11/2020 | Rees |
| 2023/0182973 | A1 | 6/2023 | Jin et al. |
| 2024/0270450 | A1 | 8/2024 | Bullock et al. |
| 2025/0019133 | A1 | 1/2025 | Monteiro Botelho |
| 2025/0176742 | A1 | 6/2025 | Jacob et al. |
| 2025/0178800 | A1* | 6/2025 | Gnesin ..... B65D 47/065 |
| 2025/0270023 | A1* | 8/2025 | Sullivan ..... B65D 51/16 |

FOREIGN PATENT DOCUMENTS

| | | | |
|---|---|---|---|
| CN | 117179510 | A | 12/2023 |
| CN | 220557797 | U | 3/2024 |
| DE | 202022000242 | U1 | 2/2022 |
| EP | 4396101 | A1 | 7/2024 |
| KR | 20-2017-0000327 | U | 1/2017 |
| WO | 2019/038269 | A1 | 2/2019 |
| WO | 2020/035595 | A1 | 2/2020 |

* cited by examiner

LID SYSTEM FOR BEVERAGE CONTAINER

TECHNICAL FIELD

Aspects provided herein relate generally to beverage containers, and more particularly, to lids for drinkware that include integrated drinking components such as slidable or pivotable nozzles or spouts and user-actuated cover mechanisms.

BACKGROUND

Many beverage containers, particularly those designed for portability and personal use, include a lid with an integrated straw or spout assembly. To improve hygiene and transportability, these lids often incorporate flip-top or pivoting straw mechanisms that allow the user to rotate the spout into a stowed position when not in use. While this stowed configuration is generally intended to protect the user-facing portion of the spout from environmental exposure, it does not fully prevent contamination.

In conventional designs, when the spout is flipped down into the stowed configuration, it typically rotates into a horizontal orientation. This exposes a lateral surface of the spout, including the region near the fluid intake or air vent hole, to contact with the outer surface of the lid or ambient environmental contaminants. In addition, such designs often require the user to manually extend or reposition the spout with their fingers, which may themselves be contaminated, thereby introducing additional hygiene concerns. Despite appearing "closed," these exposed surfaces and manual interactions may allow dirt, dust, or microbes to accumulate on or near the spout. When the spout is subsequently deployed into the upright or use configuration, any contaminants on the lateral surface or base portion of the spout may be introduced into the fluid pathway, effectively allowing the user to ingest contaminants that accumulated while the spout was stowed.

Thus, existing flip-straw beverage containers may give users a false sense of hygiene, while in reality allowing microbial or particulate exposure to occur. Furthermore, requiring users to manually flip or handle the spout during deployment increases the risk of transferring contaminants from the user's hands to the fluid-contacting surfaces. Accordingly, there is a need for an improved lid system that more effectively isolates or shields the spout or straw assembly during stowage, minimizes user contact with fluid pathway components, and enables automatic or hands-free deployment to reduce hygiene risks during use.

SUMMARY

At a high level, a lid for a beverage container is provided. The lid comprises a lid body having a top side, a bottom side, and a central hole. A slidable lid cover is movably positioned on the top side of the lid body and is configured to move along a channel between a closed position—where the central hole is covered—and an open position, where the central hole is exposed.

A recessed cavity is positioned beneath the channel, within which a straw assembly is disposed. The straw assembly comprises a removeable straw portion that extends into the beverage container and a spout positioned at the user-facing end. The spout is configured to pivot upward into a deployed or use position when the slidable lid cover is in the open position and to remain stowed within the cavity when the slidable lid cover is in the closed position. In various embodiments, the straw assembly includes at least one biasing member, such as a torsion spring, configured to urge the spout into the use position when released. In certain implementations, the straw assembly is automatically released from the stowed position upon movement of the slidable lid cover to the open position.

In some configurations, the slidable lid cover includes a first magnet, and the lid body includes a second magnet. The first and second magnets may be arranged to attract one another and bias the lid cover toward the open position upon release from a retention mechanism. In one embodiment, the magnets are arranged such that the attractive force retains the lid cover in the open position and acts as a positional stop.

By aligning the deployment of the spout with the motion of the slidable lid cover, the lid system enables hands-free spout activation, eliminating the need for the user to touch the spout during opening. This configuration reduces the risk of hand-to-mouth contamination and helps prevent exposure to environmental contaminants. When in the stowed position, the spout remains fully enclosed beneath the slidable lid cover, and the fluid passageway is sealed to block dust, debris, or microbes. The system supports one-handed operation and forms a leak-resistant seal when closed, offering a more hygienic and user-friendly solution for portable beverage containers.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

An overview of the features, functions and/or configurations of the components depicted in the various figures will now be presented. It should be appreciated that not all of the features of the components of the figures are necessarily described. Some of these non-discussed features, such as various couplers, etc., as well as discussed features are inherent from the figures themselves. Other non-discussed features may be inherent in component geometry and/or configuration.

DETAILED DESCRIPTION

The subject matter of embodiments of the present invention is described with specificity herein to meet statutory requirements. However, the description itself is not intended to limit the scope of this patent. Rather, the inventor(s) have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

Figure 1A:
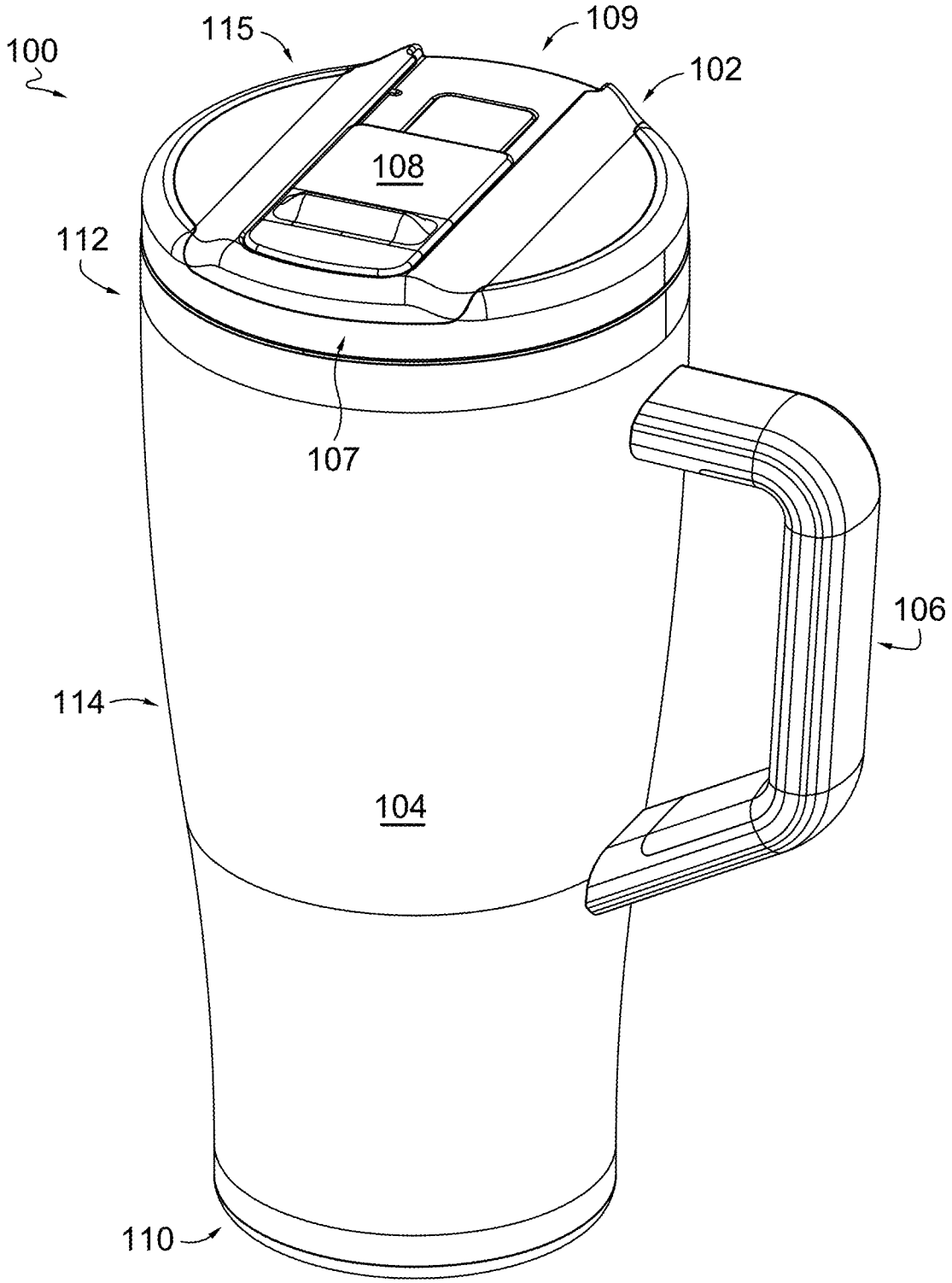
FIGS. 1A and 1B depict perspective views of an assembled beverage container with a lid in a closed configuration, in accordance with aspects herein.
Figure 1B:
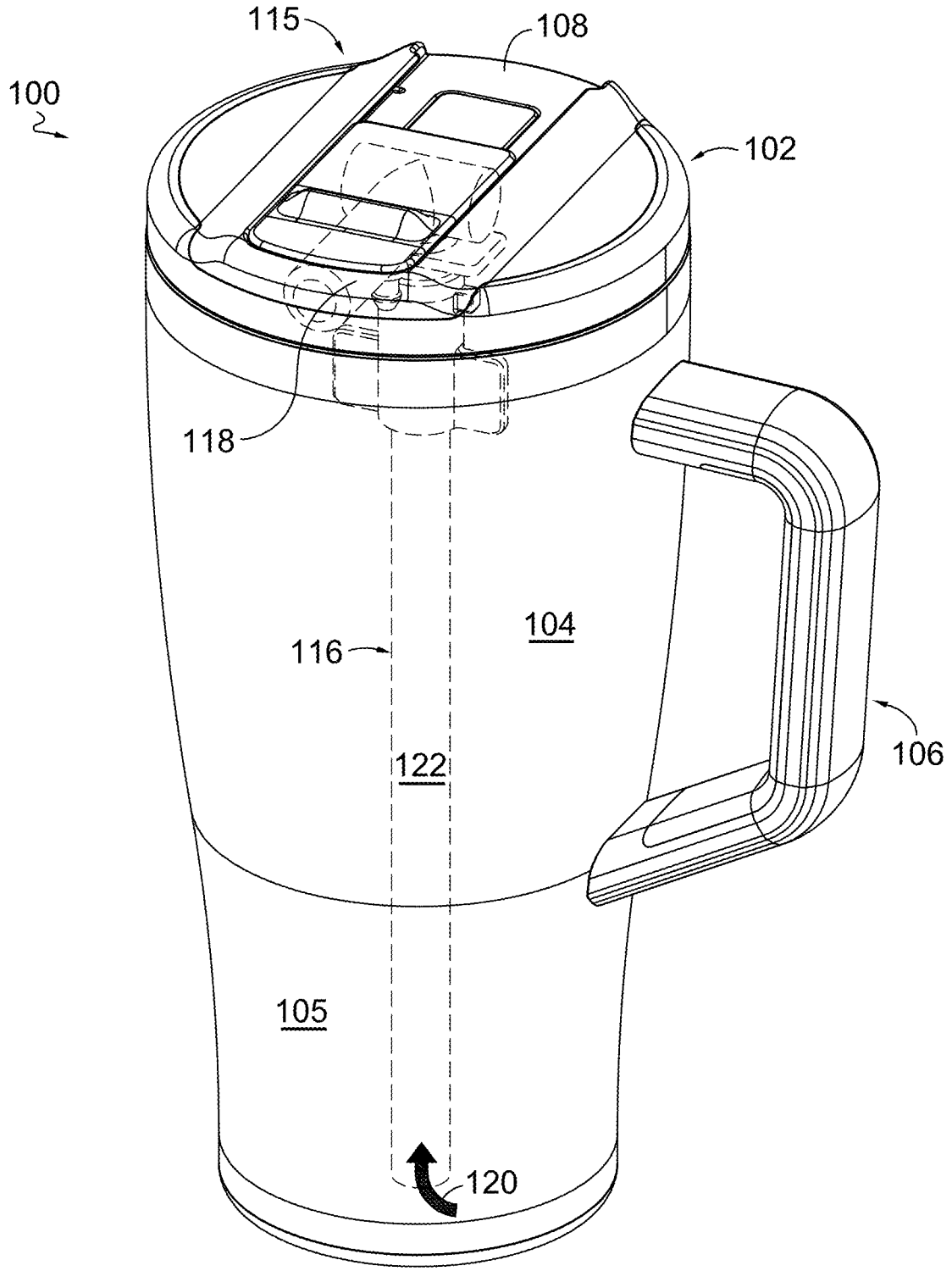

Referring now to FIGS. 1A and 1B, perspective views of a beverage container assembly 100 in a closed configuration are shown. The beverage container assembly 100 comprises a lid body 102 and a base structure (hereinafter container 104) as the main components, wherein the lid body 102 is configured to attach to the container 104. The container 104 defines a liquid reservoir 105 (depicted in FIG. 1B) and may, in some embodiments, be dual-wall vacuum-insulated for improved thermal performance. The beverage container assembly 100 may optionally further include a handle 106 to facilitate carrying. In preferred embodiments, the lid body 102 is formed from a durable polymer and includes ergonomic features, as described in more detail below.

The lid body 102 includes a lid cover 108 configured to transition between a closed position (FIGS. 1A and 1B) and an open position (FIG. 2) to selectively cover or expose a spout 118. In aspects, the lid cover 108 is a slidable lid cover operably connected to the lid body 102 via a sliding mechanism that guides linear movement along a recessed channel 202 (see FIG. 2). The channel 202 extends from a front side 107 of the lid body 102 to a rear side 109 opposite the front side 107, thereby defining the sliding path of the lid cover 108 between the closed and open positions. In the closed position shown in FIGS. 1A and 1B, the spout 118 is concealed and protected beneath the lid cover 108; in the open position shown in FIG. 2, the spout 118 is exposed for drinking. In alternative embodiments, the lid cover 108 may instead be pivotally, hingedly, or rotatably connected to the lid body 102 to achieve a similar protective function while permitting user access to the spout 118.

As shown in FIG. 1A, the container 104 comprises a first end 110 that defines a base, a second end 112 having a rim that defines an opening, and a sidewall 114 that extends between the first end 110 and the second end 112. The lid body 102 includes a top side 115 that defines the upper boundary of the lid structure. In some embodiments, the beverage container assembly 100 may further include a friction sleeve (not shown) configured to cover a portion of an outer wall of the container 104. The friction sleeve may aid in improving grip and in preventing the container from sliding across surfaces such as countertops or tables. The friction sleeve may also serve to enhance impact resistance and insulation, depending on its material composition.

As shown in FIG. 1B, the beverage container assembly 100 includes a straw assembly 116 comprising the spout 118 and a removable straw portion 122. The spout 118 extends upward through the top side 115 of the lid body 102, while the straw portion 122 extends downward from the bottom side into the liquid reservoir 105 of the container 104. Together, the spout 118 and straw portion 122 define a continuous fluid passageway 120 that enables liquid to be drawn from the liquid reservoir 105 and dispensed through the spout 118 for consumption by the user.

In the closed configuration shown in FIGS. 1A and 1B, the lid cover 108 is aligned to fully overlay and enclose the spout 118. This positioning shields the spout 118 from environmental contaminants and helps form a fluid-tight seal when the container 104 is not in use. In some embodiments, the lid cover 108 may engage with a detent, latch, or other locking feature to retain the closed position. To expose the spout 118 for drinking, the user may actuate the lid cover 108 using an actuator mechanism, described further below, transitioning it from the closed configuration to the open configuration.

Figure 2:
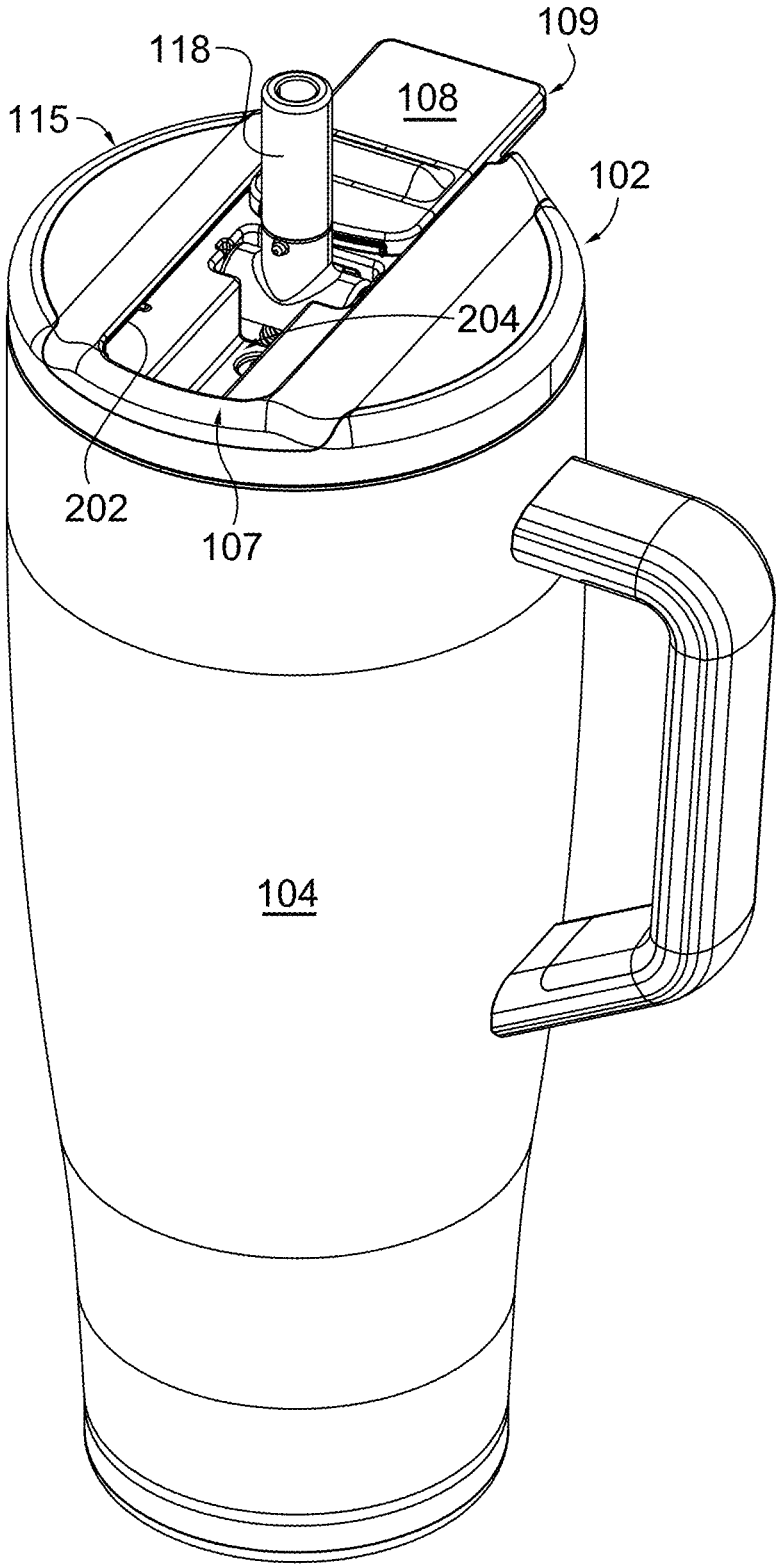
FIG. 2 depicts a perspective view of the beverage container with the sliding cover in the open position, in accordance with aspects herein.

As shown in FIG. 2, the lid cover 108 is in the open position, with the spout 118 exposed and projecting upward from the top side 115 of the lid body 102. As discussed above, the lid body 102 includes the channel 202 formed on the top side 115, extending from the front side 107 toward the rear side 109, and defining a recessed guide path for the lid cover 108. A cavity 204 is positioned beneath the channel 202 and configured to house the straw assembly 116 when stowed. The straw assembly 116 is disposed within the cavity 204 and configured to pivot between a recessed position and an upright position aligned with a central hole (described in FIG. 8) formed through the top side 115 of the lid body 102. The channel 202 may include opposing inner walls or rails that retain and guide the lid cover 108 during movement. In some embodiments, the lid cover 108 includes complementary engagement features, such as flanges or guide tabs, that cooperate with the channel 202 to ensure smooth and aligned actuation.

Figure 3:
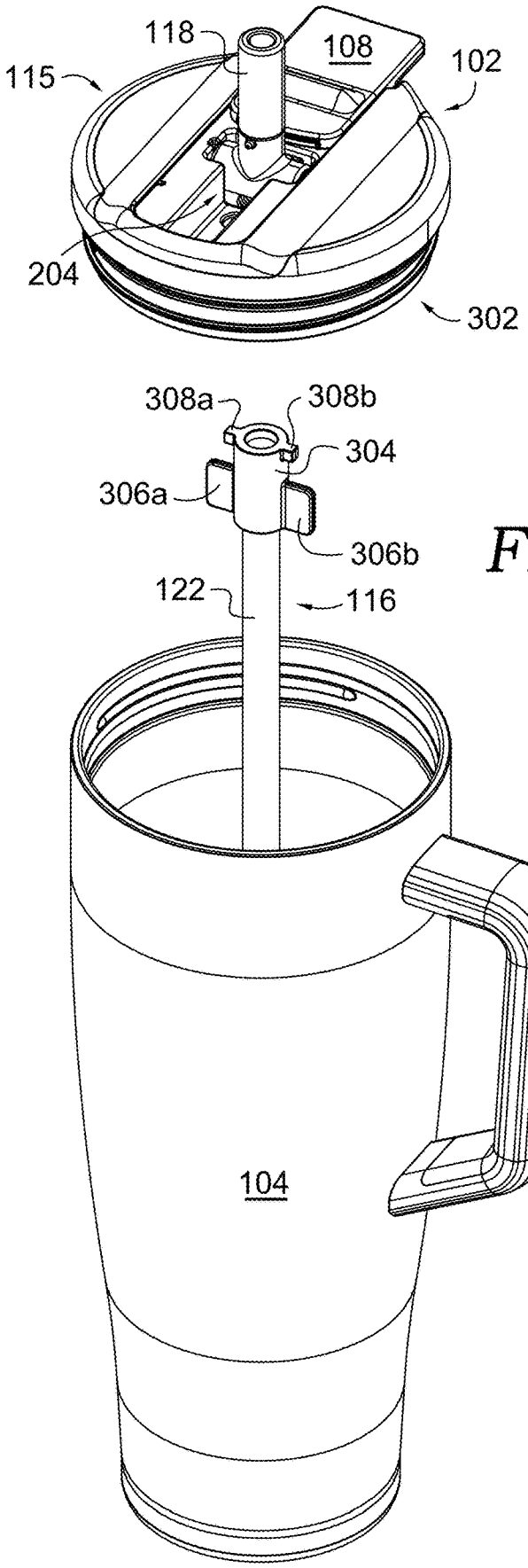
FIG. 3 depicts an exploded perspective view of the beverage container and lid system, in accordance with aspects herein.
Figure 9:
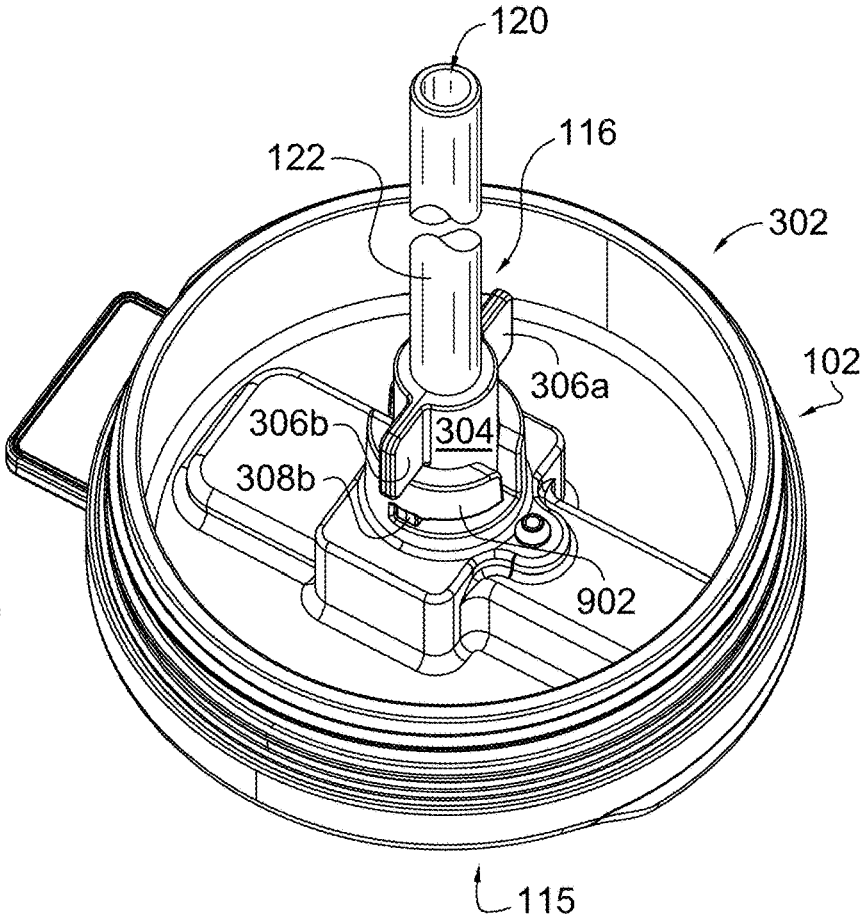
FIG. 9 is a bottom perspective view of the lid body, in accordance with aspects herein.

Referring now to FIG. 3, an exploded view of the lid body 102 and straw assembly 116 is shown. In the illustrated configuration, the spout 118 of the straw assembly 116 is shown in its open, deployed state, extending upward from the top side 115 of the lid body 102. The spout 118 is supported by and pivotally mounted within the cavity 204, with a base portion (e.g., base portion 419 described in FIG. 4) of the spout 118 remaining housed in the cavity 204. A connection port, such as connection port 902 shown in FIG. 9, is located on the bottom side 302 of the lid body 102 and is configured to receive the straw assembly 116 in proper alignment with the fluid passageway 120 described above.

As further shown in FIG. 3, the straw assembly 116 includes a keyed interface system comprising a sleeve 304, one or more laterally projecting straw wings 306*a*, 306*b*, and one or more laterally projecting straw tabs 308*a*, 308*b*. These straw tabs 308*a*, 308*b* are configured to engage with corresponding guide or locking structures within the connection port 902 (see FIG. 9). During installation, the straw assembly 116 is inserted axially into the connection port 902 and then rotated to achieve a locked, keyed engagement, with the straw wings 306*a*, 306*b* providing user-engagement surfaces that facilitate rotation. This configuration ensures proper orientation and secure retention during use. One embodiment of such a keyed straw system is described in U.S. patent application Ser. No. 18/529,703, filed Dec. 5, 2023, titled "Keyed Straw," which is hereby incorporated by reference in its entirety.

Figure 4:
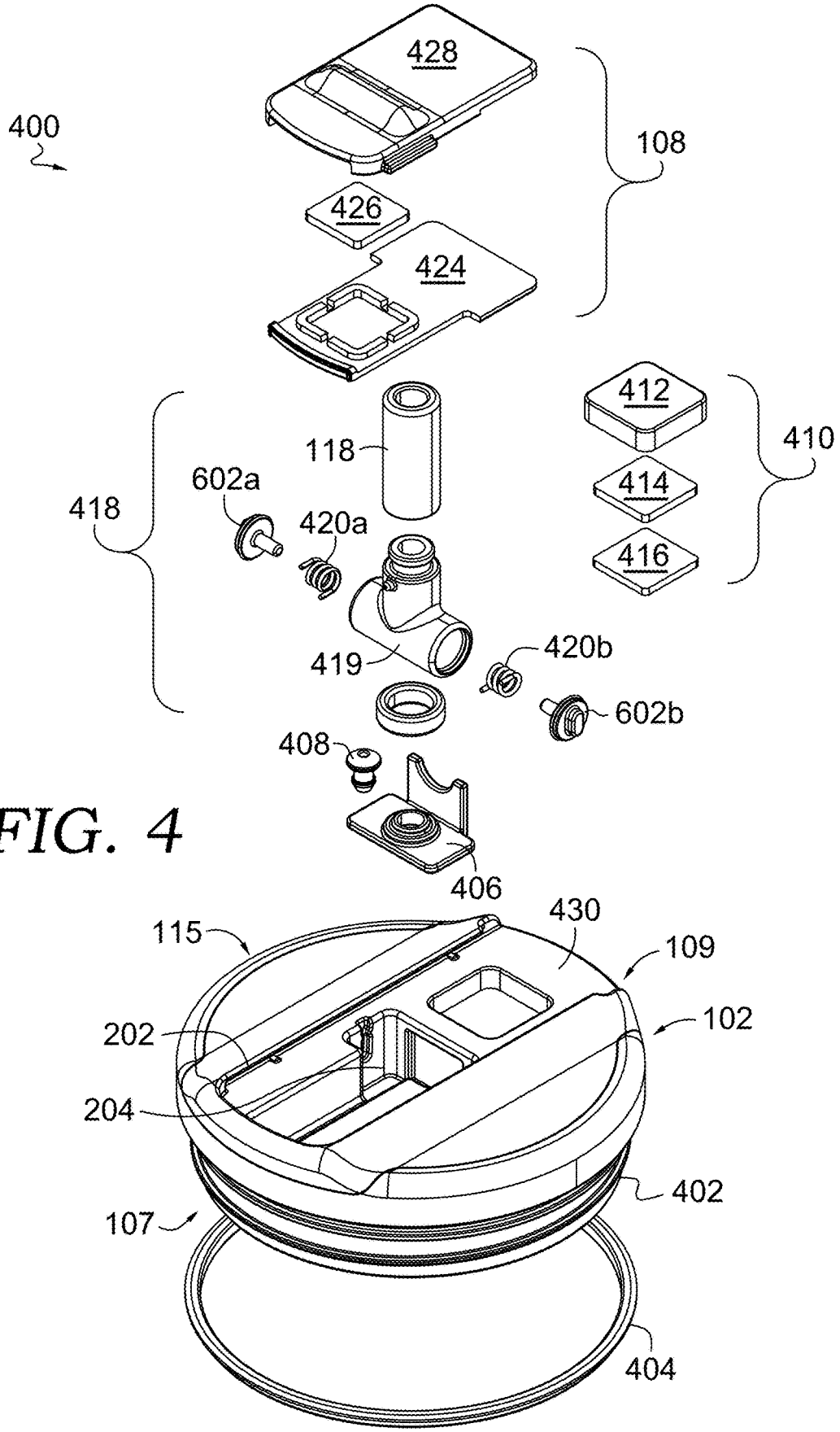
FIG. 4 depicts an exploded perspective view of the lid assembly, in accordance with aspects herein.

Referring now to FIG. 4, an exploded view of the lid cover system 400 is shown. The lid body 102 is configured to be removably secured to the container 104 to enclose the liquid reservoir 105. In various embodiments, the lid body 102 may include attachment mechanisms such as internal or external threading, bayonet-style locks, snap-fit geometries, press-fit interfaces, or combinations thereof. In a preferred configuration, the lid body 102 engages the container 104 via a threaded interface 402, forming a tight, leak-resistant seal that supports hygienic transport and prevents spillage.

The lid body 102 includes multiple subcomponents designed to facilitate fluid flow, hygienic access, and reliable sealing. The lid body may be formed from a durable polymer material, such as polypropylene (PP), polycarbonate, ABS, HDPE, silicone, or combinations thereof. It is contemplated that, in some embodiments, the durable polymer material comprises a copolyester, such as Tritan™, to provide enhanced impact resistance, clarity, and chemical durability. The lid body 102 may further include a co-molded thermoplastic rubber (TPR) grip extending around its outer periphery to improve ergonomics and assist users during installation or removal. Positioned beneath the lid body 102, a lid gasket 404 made from food-grade silicone is configured to engage with the upper rim of the container 104 and the lid body 102 and form a liquid-tight seal when assembled.

Disposed within the cavity 204 of the lid body 102 is a removable straw gasket 406 formed from food-grade silicone. The removable straw gasket 406 surrounds the base portion 419 of the spout 118, forming a seal at the outlet of the internal fluid passageway 120 when the spout 118 is in the stowed position. In addition to preventing leaks, the removable straw gasket 406 provides mechanical guidance that helps the spout 118 align with the central hole 802 (see FIG. 8) during deployment.

Adjacent to the removable straw gasket 406, the cavity 204 also houses an air vent comprising a vent hole 804 (FIG. 8) and a compliant seal structure. The vent hole 804 is configured to admit ambient air into the container 104 during drinking, supporting pressure equalization and continuous fluid flow. To control airflow, the spout assembly 418 includes an air vent plug 408 that mates with the vent hole 804 when the spout 118 is stowed. As the spout 118 pivots upward, the air vent plug 408 is displaced, unsealing the vent hole 804 and allowing air to enter the container 104.

In the stowed configuration, the spout 118 is pivoted into a horizontal stowed position such that its base 419 simultaneously seals against the removable straw gasket 406 and the air vent opening 804. This dual-contact arrangement creates a complete seal across both the fluid and air pathways, supporting leak prevention. When the lid body is in the open configuration, the spout 118 rotates into an upright position, disengaging from both the straw gasket 406 and the air vent plug 408. This transition opens the fluid passageway 120 and reactivates the air vent 804 to support smooth, uninterrupted dispensing.

The lid cover system 400 includes a magnet-assisted actuation mechanism 410 that facilitates user-friendly sliding of the lid cover 108. In the illustrated embodiment, the mechanism comprises a polypropylene (PP) magnet housing cap 412, a first neodymium magnet 414, and a magnet cover 416. When the retention mechanism is released, these components bias the lid cover 108 toward the open position. Other actuation mechanisms may include spring-biased detents, cam tracks, or latch-release systems that achieve similar automatic movement. Optional variations include integrated flexures, cantilever springs, or elastomeric arms molded into the lid body 102.

The lid cover system 400 includes a spout assembly 418 comprising a spout 118 shaped in an inverted T-configuration and configured to pivot between a stowed and upright position. The base portion 419 nests within the cavity 204 and aligns with the central hole 802 (see FIG. 8) that passes vertically through the lid body. In the deployed state, the spout 118 extends through the central hole 802 to allow fluid communication from the internal passageway 120 to the user-facing outlet.

To facilitate hands-free deployment, the spout assembly 418 is coupled to one or more biasing members that urge the spout upward from its recessed position. For example, in FIG. 4, the biasing member comprises a pair of torsion springs 420*a* and 420*b* embedded in opposing lateral regions of the spout base 419. These springs store rotational energy when compressed and automatically rotate the spout 118 into the upright position when released. Alternative embodiments may use cantilever beams, elastomeric arms, or integral flexures made from stainless steel or any other suitable material. This mechanism eliminates the need for direct user contact with the spout, enhancing hygiene and convenience.

In aspects, the straw assembly may include a cap attachment feature configured to maintain a 90-degree orientation when the removable straw 122 is detached. This fixed positioning streamlines reinsertion and ensures consistent fluid alignment with the spout 118.

The lid cover 108 includes a rigid PP slider base 424, a second neodymium magnet 426, and a co-molded TPR grip 428. The slider base 424 enables low-friction movement within the recessed channel 202, while the TPR grip 428 enhances tactile control, even when the user's hands are wet. The embedded second magnet 426 is configured to interact with a first magnet 414 fixed within the lid body 102. Together, the first and second magnets 414, 426 form part of a magnet-assisted actuation mechanism that biases the lid cover 108 toward the open position once released from its locked or retained state.

During lid cover actuation, the first and second magnets 414, 426 are arranged to produce an attractive force that assists in transitioning the lid cover 108 rearward toward the open position. This magnetic interaction helps complete the sliding motion and retains the lid cover 108 in the open configuration. In aspects, in the closed position, the first and second magnets 414, 426 may produce a repelling force to facilitate initial separation of the lid cover 108 from the spout 118.

When fully closed, the lid cover 108 is seated within the recessed channel 202 such that its upper surface lies substantially flush with the surrounding top side 115 of the lid body 102, forming a clean, continuous outer profile. The lid cover 108 overlays both the spout 118 and the air vent 408, providing protection from debris, dust, and environmental contaminants.

Figure 5A:
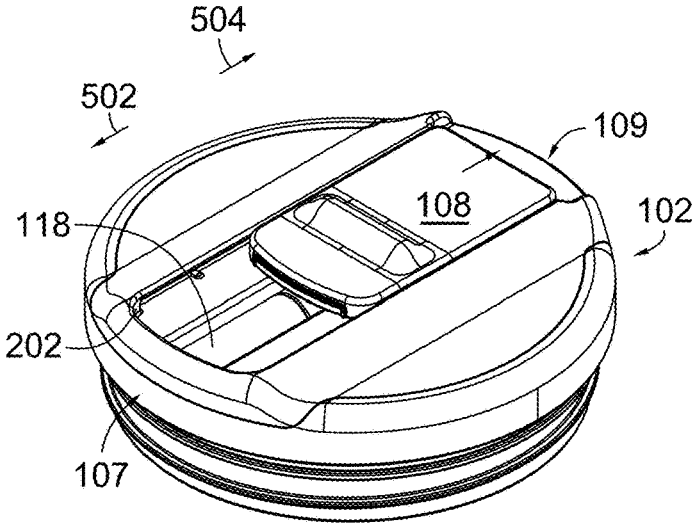
FIGS. 5A-5C depict progressive views of the lid system during the transition from the closed configuration to the open configuration, in accordance with aspects herein.
Figure 5B:
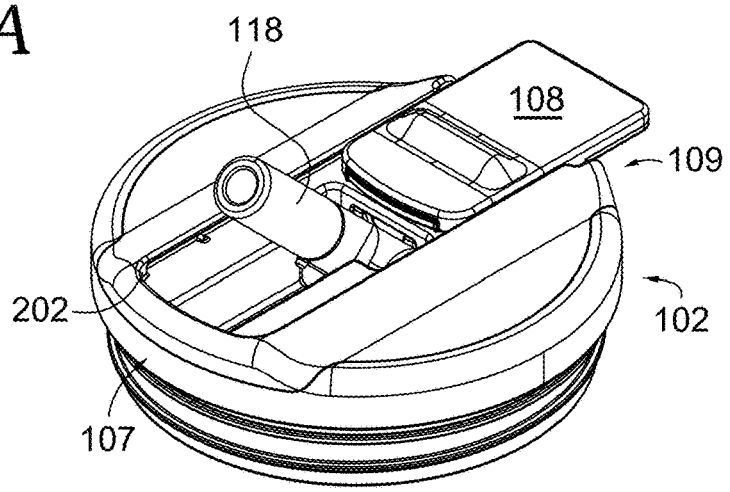
Figure 5C:
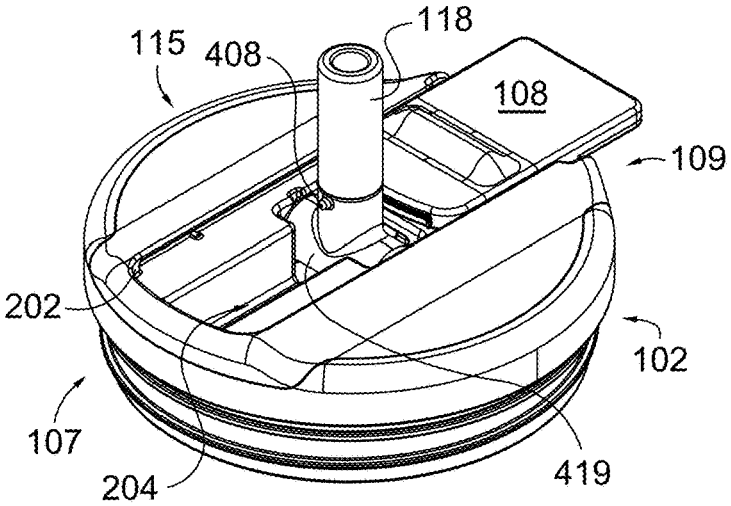

Referring now to FIGS. 5A through 5C, sequential views are shown to illustrate the actuation of the lid cover 108 and the corresponding deployment of the spout 118. For clarity, the term "forward" refers to the direction toward the front side 107 of the lid body 102, as indicated by directional arrow 502. This direction corresponds to the closed position of the lid cover 108, shown in FIGS. 1A and 1B. Conversely, "rearward" refers to the direction toward the rear side 109 of the lid body 102, as indicated by directional arrow 504 and corresponding to the open position of the lid cover 108, shown in FIG. 2.

As shown in FIG. 5A, the user initiates actuation by sliding the lid cover 108 rearward (e.g., direction 504), past a set of forward travel stops (not shown). Once the lid cover 108 clears these stops, the first and second magnets 414, 426 of the magnet-assisted actuation mechanism 410 (previously described in FIG. 4) take over, biasing the lid cover 108 toward the fully open position along the guided sliding path (e.g., channel 202). At this point in the sequence, the spout 118 remains in its horizontal, stowed position within the cavity 204 of the lid body 102.

In FIG. 5B, the lid cover 108 continues moving in the rearward direction 504 under the influence of the magnetic force, gradually uncovering the cavity 204 region containing the spout 118. As the lid cover 108 clears this cavity 204 region, the torsion springs 420*a* and 420*b* (described in FIG. 4) release stored rotational energy. This spring force pivots the spout 118 upward from its stowed configuration toward a vertical orientation.

By the state shown in FIG. 5C, the lid cover 108 has reached its fully rearward position, and the spout 118 is fully deployed, extending approximately 90 degrees upward relative to the top side 115 of the lid body 102. This automatic spring-biased movement eliminates the need for manual adjustment of the spout 118, enhancing hygienic operation and user convenience. In alternative embodiments, the upward actuation may be driven by alternative biasing mechanisms, including cantilever springs, elastomeric flexures, or motorized assist systems.

To return the lid body 102 to the closed configuration, the user may slide the lid cover 108 in the forward direction 502, toward the front side 107 of the lid body 102. As the lid cover 108 advances along the channel 202, it contacts the base portion 419 of the spout 118 and applies a downward force that pivots the spout 118 into its horizontal, recessed position within the cavity 204. Continued forward motion guides the lid cover 108 over the stowed spout 118 and returns it to the closed position, where it sits flush with the top side 115 of the lid body 102. The spout 118 is retained in the recessed configuration by engagement with friction-fit surfaces, detents, or mating contours formed between the lid cover 108 and surrounding portions of the lid body 102. In some embodiments, one or more retention features, such as molded protrusions, flexible tabs, or recessed catch structures, secure the lid cover 108 in place, enhancing leak resistance and maintaining a hygienic seal until the next use.

Figure 6A:
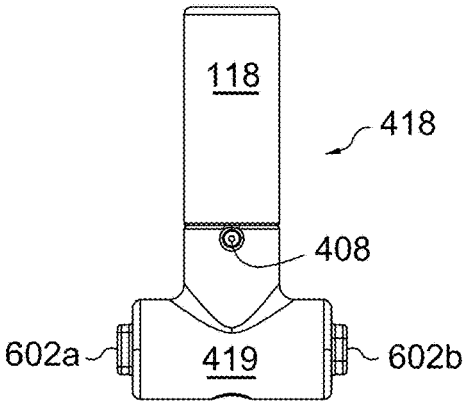
FIGS. 6A-6D depict the straw assembly in various positions relative to the lid body, in accordance with aspects herein.

Referring now to FIGS. 6A through 6D, various views are provided illustrating the structure and installation process of the spout assembly 418 relative to the lid body 102. As shown in FIG. 6A, the spout assembly 418 includes two indexing caps 602*a* and 602*b* positioned on opposite lateral ends of the base portion 419. These indexing caps 602*a* and 602*b* are rotatable and permanently affixed to the base portion 419. In aspects, each indexing cap of the two indexing caps 602*a* and 602*b* features asymmetrically sized slots, one small and one large, that are configured to engage corresponding alignment structures within the cavity 204 or the lid body 102. This asymmetrical configuration ensures that the base portion 419 may only be reinserted into the lid body 102 in the correct orientation, maintaining proper alignment for reliable sealing and fluid communication. In alternative embodiments, the indexing caps 602*a* and 602*b* may have the same shape or may include non-circular or keyed geometries to interface with complementary channels or inserts molded into the walls of the cavity 204.

Figure 6B:
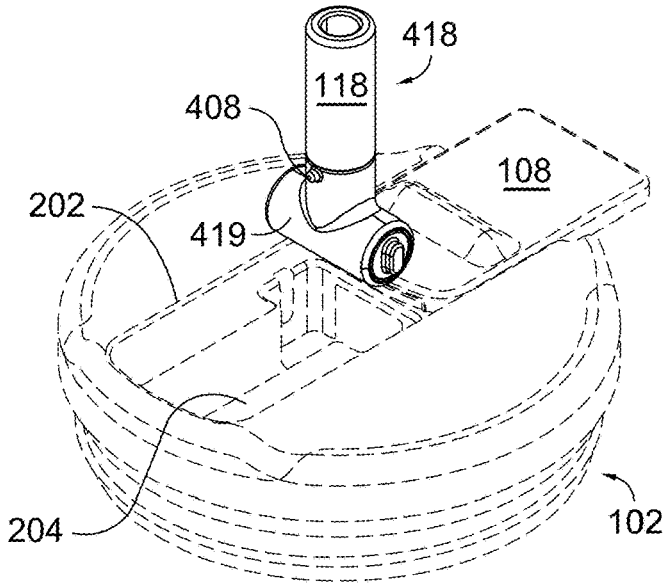
Figure 6C:
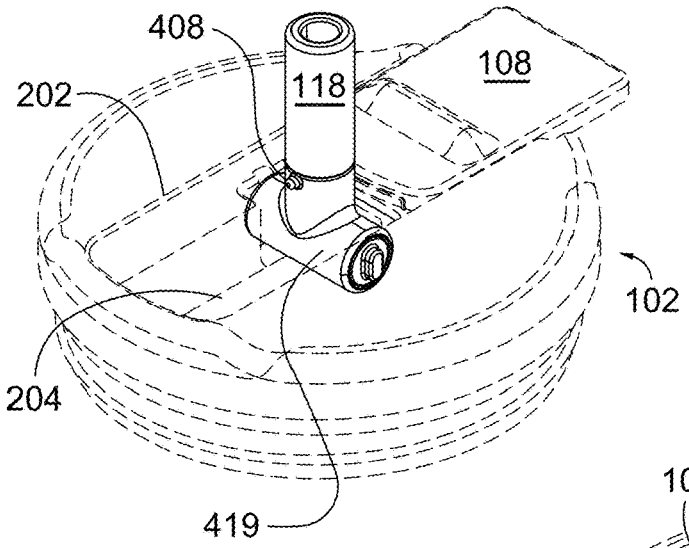

FIG. 6B shows the spout assembly 418 being aligned with the receiving cavity 204 formed within the lid body 102, positioned beneath the channel 202. The indexing caps 602*a* and 602*b* are oriented to align with mating receptacles that guide the spout assembly 418 into place. In FIG. 6C, the base portion 419 is shown fully inserted into the cavity 204, with the indexing caps engaging locking features to secure the assembly rotationally and axially.

Figure 6D:
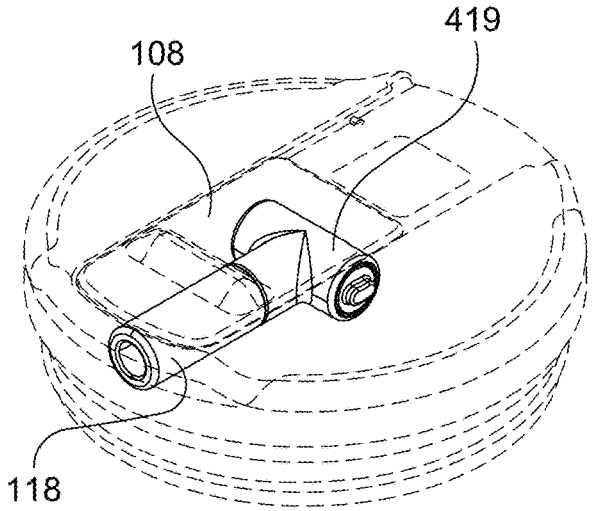

As shown in FIG. 6D, once installed, the base portion 419 is capable of rotating downward into the stowed configuration within the cavity 204. This movement enables the spout 118 to retract fully beneath the lid cover 108 as the lid cover 108 slides forward along channel 202.

Figure 7A:
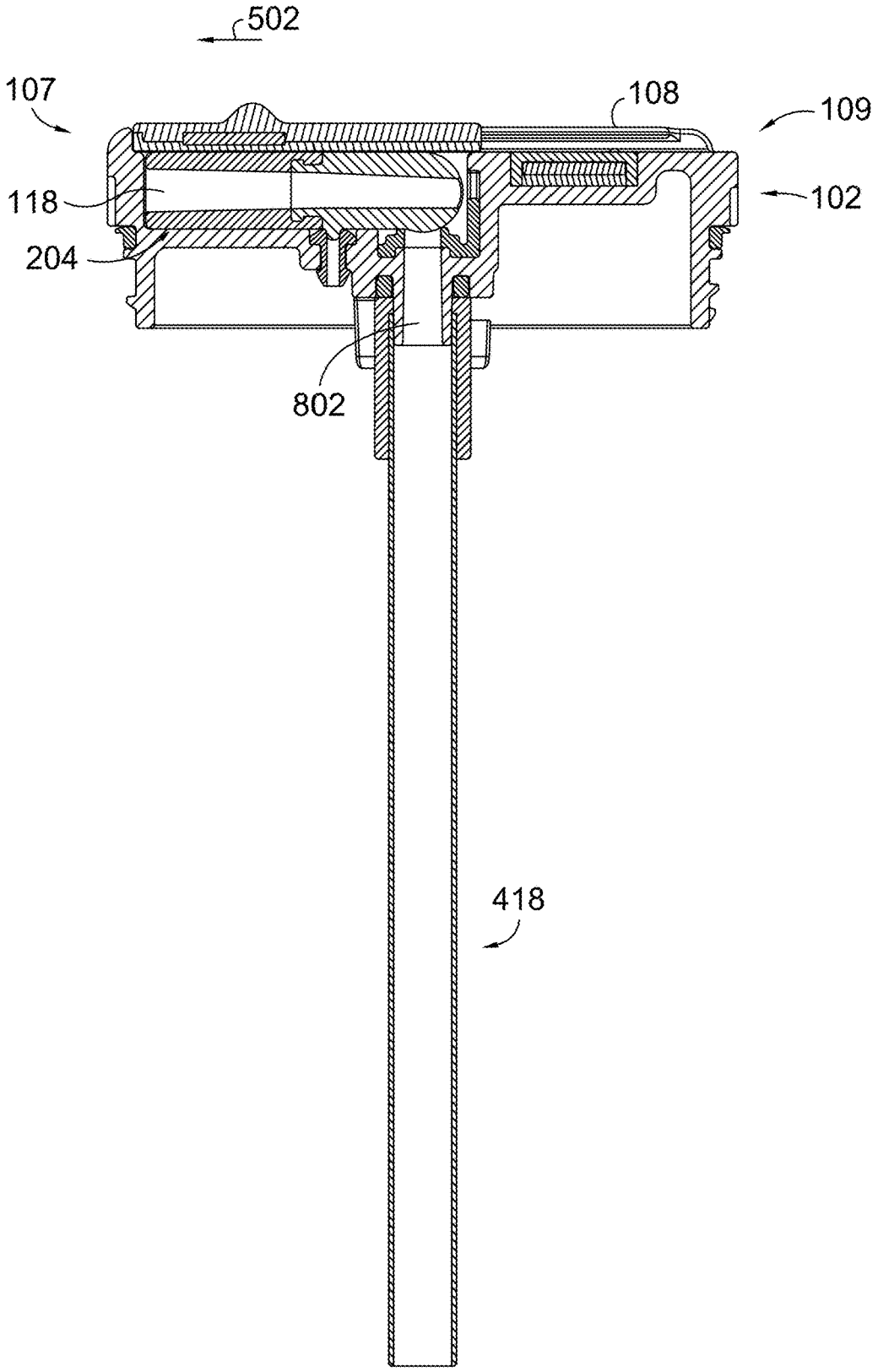
FIG. 7A is a cross-sectional side view of the lid in the closed position, in accordance with aspects herein.
Figure 7B:
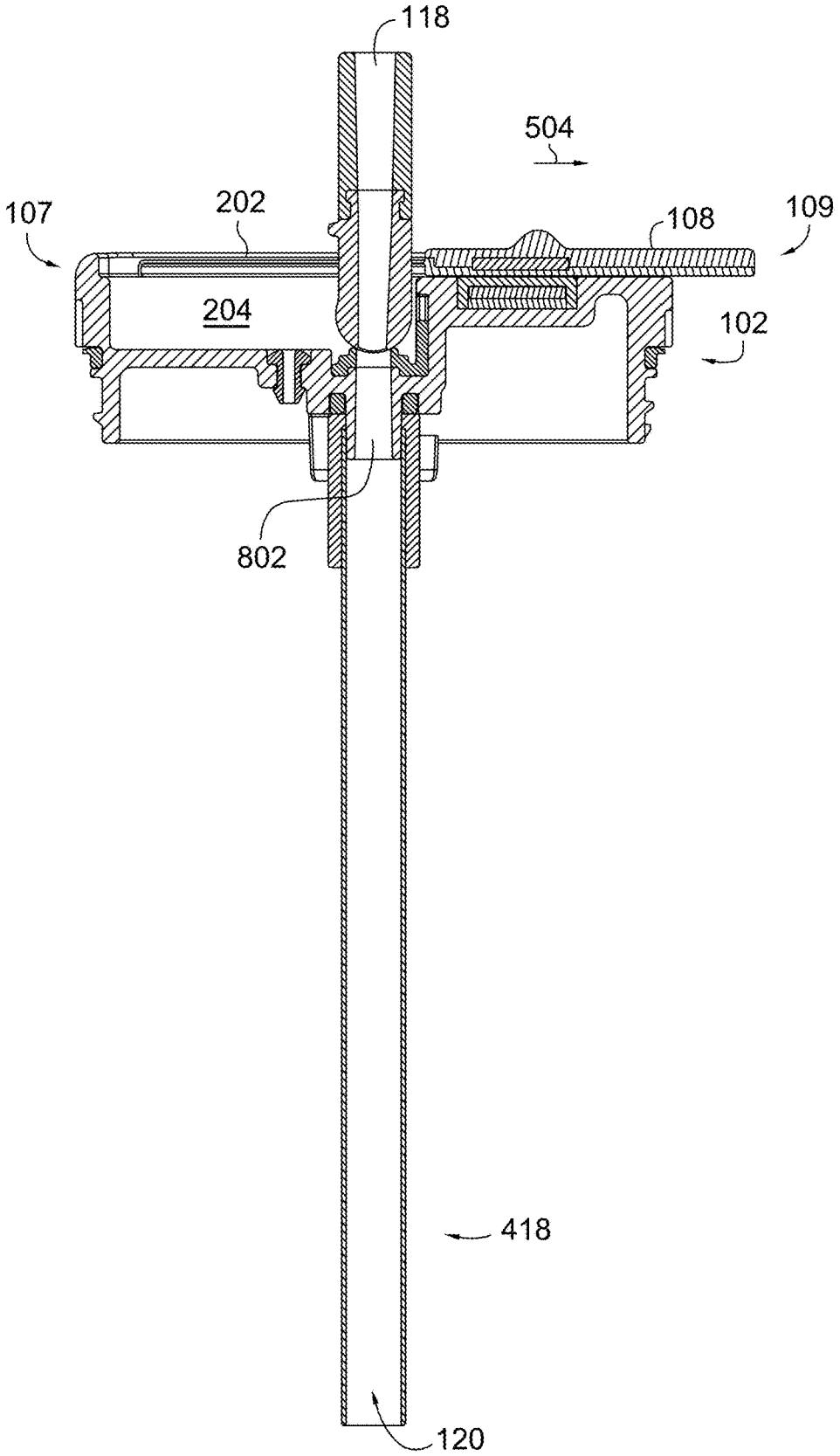
FIG. 7B is a cross-sectional side view of the lid in the open position, in accordance with aspects herein.

Referring now to FIGS. 7A and 7B, cross-sectional views are shown illustrating the internal configuration of the lid body 102 in both the closed and open positions of the spout assembly 418. In FIG. 7A, the spout assembly 418 is in the stowed configuration, with the spout 118 rotated downward into the cavity 204. The lid cover 108 overlays the spout 118 and has been advanced fully in the forward direction 502 along the channel 202 toward the front side 107 of the lid body 102. In this configuration, the lid cover 108 encloses the spout 118, shielding it from environmental contaminants and forming a sealed outer surface. The forward motion of the lid cover 108 applies downward pressure on the spout 118, retaining it within the cavity 204 and sealing the central hole 802 from external exposure.

FIG. 7B depicts the corresponding open configuration. The lid cover 108 has been retracted in the rearward direction 504 along channel 202 toward the rear side 109 of the lid body 102. This movement disengages the lid cover 108 from the spout 118, allowing the spout 118 to rotate upward into its deployed position under spring force. In this position, the spout 118 projects vertically from the cavity 204, aligning the spout 118 over the central hole 802 and the fluid passageway 120 to permit liquid to be dispensed.

Figure 8:
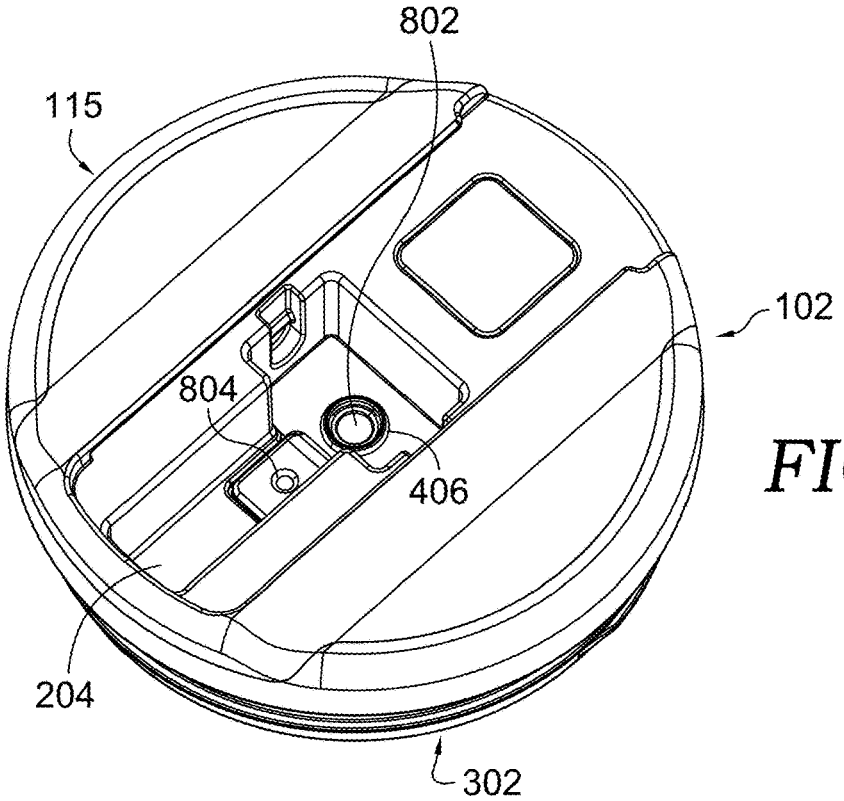
FIG. 8 is a top-down view of the lid body, in accordance with aspects herein.

Referring now to FIG. 8, a top-down view of the lid body 102 is shown, illustrating the central hole 802 and associated gasket components. In the depicted embodiment, the central hole 802 is formed through the top side 115 of the lid body 102 and is centrally located within the recessed cavity 204. The central hole 802 is configured to align with the spout 118 of the spout assembly 418, allowing the spout 118 to extend through the central hole 802 when in an upright position and thereby establish fluid communication with the underlying liquid reservoir 105.

The straw gasket 406 (described in FIG. 4) is removably disposed within the cavity 204 and surrounds the central hole 802. The straw gasket 406 is made of food-grade silicone and is shaped to conform to the base portion 419 of the spout 118. When the spout 118 is in the stowed, closed position, the straw gasket 406 is configured to seal against the exterior of the base portion 419 to block fluid passage and inhibit leakage from the container 104. When the spout 118 pivots to the upright, deployed position, the base portion 419 lifts from the straw gasket 406, unsealing the fluid outlet path and enabling fluid to be dispensed through the central hole 802.

In the illustrated embodiment, an air vent 804 is positioned within the cavity 204 adjacent to the central hole 802. The air vent 804 may be disposed in a dedicated recessed region and includes a compliant gasket or plug formed from food-grade silicone. In use, the vent plug 408 component of the spout assembly 418 is configured to engage and occlude the air vent 804 when the spout 118 is in the stowed position, blocking airflow and contributing to leak resistance. When the spout 118 transitions to the upright, deployed position, the vent plug 408 is displaced, unsealing the air vent 804 and permitting ambient air to enter the container 104. This airflow pathway maintains pressure equilibrium and enables consistent liquid flow during dispensing. As shown in FIG. 8, the straw gasket 406 and the gasket associated with the air vent 804 may be formed as a single, unitary gasket component. The unitary gasket may define separate openings for the spout 118 and the air vent 804 and may conform to the geometry of the cavity 204. Such gaskets may be circular, elliptical, or asymmetrical, and may be installed via friction fit, keyed alignment, or snap-in engagement. This unitary configuration facilitates user cleaning, simplifies reassembly, and reduces the number of separate parts in the lid body 102. In alternative embodiments, however, these gaskets 802, 804 may be separate pieces, each independently seated within the cavity 204.

Referring now to FIG. 9, a bottom view of the lid body 102 is shown, illustrating the bottom side 302 of the lid body 102 and the connection port 902. The connection port 902 is integrally formed within the lid body 102 and is disposed beneath the cavity 204. It is configured to receive and support the straw assembly 116 in a manner that ensures both mechanical engagement and fluid communication. The connection port 902 is aligned with the internal fluid passageway 120, which extends vertically through the lid body 102 between the central hole 802 and the liquid reservoir 105. In the depicted embodiment, the connection port 902 is dimensioned and shaped to accept a keyed interface of the straw assembly 116, such as that described in connection with FIG. 3, to ensure correct orientation during assembly. The removable straw 122 may be coupled to the bottom side of the lid body 102 at the connection port 902. When installed, the removable straw 122 interfaces with a straw support structure within the spout assembly 418, thereby forming a continuous fluid passageway through the lid body 102 from the liquid reservoir 105 to the spout 118.

The connection port 902 includes internal retention and alignment features, such as circumferential grooves, axial slots, or bayonet channels, that are configured to engage with corresponding mating features on the straw assembly 116 (e.g., straw tabs 308*a*, 308*b*). These features are designed to provide both axial retention and rotational alignment, ensuring that the straw assembly 116 is disposed in the correct position for fluid communication and sealing. In typical operation, the user may insert the straw assembly 116 axially into the connection port 902 and then rotate or twist it to lock into place using the integrated alignment features. This engagement forms a sealed, continuous fluid pathway 120 through the lid body 102. In alternative embodiments, the connection port 902 may support different straw geometries or attachment mechanisms, including snap-fit interfaces, keyed rotational couplings, or integrated sealing gaskets. These configurations are intended to enhance leak resistance, facilitate assembly by end users, and maintain hygienic conditions along the fluid flow path.

In aspects, to facilitate straw reinsertion, the lid body 102 may include a stop feature positioned adjacent to the connection port 902. The stop feature is configured to maintain the connection port 902 at an approximately 90-degree orientation relative to the bottom side 302 of the lid body 102 when the removable straw 122 is detached. This configuration preserves alignment of the connection port 902 and simplifies reattachment of the removable straw 122 by the user.

Additionally, although some exemplary implementations of the embodiments described herein are shown in the accompanying figures, these implementations are not intended to be limiting. Rather, it should be understood that the various embodiments and aspects described herein may be implemented upon any insulated container.

As used herein, "straw" refers to an elongated fluid-conducting tube or conduit that enables the transfer of liquid from the container to the spout. The straw may be rigid or flexible and is typically removably attached to the underside of the lid structure to draw liquid from the liquid reservoir.

As used herein, "spout" refers to a fluid outlet configured to dispense liquid from the fluid passageway to a user. The spout may pivot between a stowed position and a deployed position and may be shaped in a variety of configurations, including an inverted T-shape.

As used herein, "fluid passageway" refers to the internal conduit formed within the lid structure that fluidly connects the liquid reservoir to the spout. The passageway may extend between the connection port on the bottom side of the lid and the central hole on the top side through which the spout projects.

As used herein, "liquid reservoir" refers to the internal volume of the beverage container configured to store liquid. The reservoir is defined by the container body and is enclosed by the lid structure when installed.

As used herein, "lid cover" refers to a movable component configured to selectively cover or uncover an opening in the lid structure. The lid cover may be slidable, hinged, or pivotable, and is positioned on the top side of the lid. In the slidable configuration, the lid cover is guided along a defined path to transition between open and closed positions, thereby regulating access to the spout and supporting hygienic sealing.

As used herein, "magnet" refers to a magnetic element incorporated into the lid structure or lid cover to assist with actuation, retention, or alignment. Magnets may be arranged to create repelling or attracting forces, depending on polarity, and may be embedded in polymer housings or used in conjunction with mechanical stops to influence the motion of the lid cover.

As used herein, "torsion spring" refers to a mechanical biasing element configured to store and release rotational energy. Within the lid system, torsion springs are used to bias the spout toward an upright, deployed position when the lid cover is moved to an open configuration. The torsion spring may be formed of metal or polymer and housed within the lid to apply force to a rotatable spout base or other movable component.

As used herein, "gasket" refers to a sealing element made of a compliant material, such as silicone, configured to create a fluid-tight or air-tight interface between components of the lid structure. Gaskets may be removably or permanently installed and may define openings to accommodate fluid or air flow.

As used herein, "central hole" refers to the main opening formed through the lid structure that aligns with the spout for fluid communication. The central hole serves as the outlet of the fluid passageway.

As used herein, "connection port" refers to a receiving structure formed on the underside of the lid structure and configured to engage with a straw assembly. The connection port provides both mechanical and fluidic connection to the internal fluid passageway.

As used herein, "indexing cap" refers to a rotational element affixed to the lateral ends of a straw base, configured to engage alignment features in the lid structure to ensure proper orientation and insertion of the straw assembly.

As used herein, "cavity" refers to a recessed region formed within the lid structure that houses various internal components, such as the spout, gaskets, and air vent. The cavity is accessible from both the top and bottom sides of the lid and may include internal channels or support features.

As used herein, "air vent" refers to a component configured to permit airflow into the liquid reservoir to maintain internal pressure equilibrium during fluid dispensing. The air vent may include a compliant sealing gasket and may be positioned adjacent to the central hole.

As used herein, "straw gasket" refers to a sealing component positioned within the cavity of the lid structure and configured to surround the central hole. The straw gasket is typically formed of a compliant, food-grade material, such as silicone, and is shaped to interface with the base portion of the spout. When the spout is in the deployed position, the straw gasket forms a fluid-tight seal around the base portion to support leak resistance and maintain hygienic operation during use. In some embodiments, the straw gasket may be removably installed and may include molded features that align with surrounding lid components.

As used herein, "base portion" refers to the lower segment of the spout configured to interface with the straw gasket and fluid passageway. The base portion may include features for sealing, rotation, or alignment within the cavity of the lid structure.

As used herein, "travel stop" refers to a structural feature that limits the sliding movement of the lid cover to prevent over-extension. Travel stops may be integrated into the lid or lid cover and may define the boundaries of the open and closed positions.

As used herein, "channel" refers to a recessed track formed on the top side of the lid structure, configured to guide the movement of the slidable lid cover. The channel extends between the front and rear sides of the lid and may include internal walls or rails to constrain lateral motion and ensure proper alignment of the lid cover during sliding. In some embodiments, the channel may be integrally molded with the lid structure or formed as a separate insert and may interface with complementary engagement features on the lid cover, such as flanges or guide tabs, to enable controlled actuation between open and closed positions.

As used herein, "forward" refers to the direction extending toward the front side of the lid structure, typically the user-facing edge, corresponding to the closed position of the slidable lid cover.

As used herein, "rearward" refers to the direction extending away from the front side of the lid structure, toward the rear side, corresponding to the open position of the slidable lid cover.

As used herein, "open position" refers to a configuration in which the slidable lid cover is retracted toward the rear side of the lid structure, such that the spout is exposed for fluid dispensing and ambient airflow is permitted via the air vent.

As used herein, "closed position" refers to a configuration in which the slidable lid cover is advanced toward the front side of the lid structure, such that the spout and vent opening are fully covered and sealed to prevent fluid leakage and contamination.

As used herein, "actuation" refers to the user-initiated or automatic movement of a component within the lid system, such as the slidable lid cover or the spout. Actuation may occur via manual force, magnetic biasing, spring force, or other mechanical mechanisms configured to control transitions between open and closed configurations.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

What is claimed is:

1. A lid for a beverage container, comprising:

a lid body having a top side, a bottom side, and a central hole;

a channel recessed on the top side and extending between a front side and a rear side of the lid body;

a slidable lid cover movably retained within the channel and configured to transition between a closed position that covers the central hole and an open position that exposes the central hole;

a cavity disposed beneath the channel and extending from the front side of the lid body to at least the central hole; and a straw assembly disposed within the cavity, the straw assembly being configured to pivot upward into alignment with the central hole when the slidable lid cover is in the open position and to remain stowed within the cavity when the slidable lid cover is in the closed position.

2. The lid of claim 1, wherein the straw assembly includes at least one biasing member configured to urge the straw assembly upward into alignment with the central hole.

3. The lid of claim 2, wherein the at least one biasing member comprises at least one torsion spring.

4. The lid of claim 1, wherein the straw assembly is automatically released from its stowed configuration within the cavity upon movement of the slidable lid cover to the open position.

5. The lid of claim 1, further comprising:

a removable straw coupled to the bottom side of the lid body and aligned with the central hole to establish fluid communication with the straw assembly when the straw assembly is in the open position.

6. The lid of claim 1, further comprising:

an air vent positioned in the cavity between proximate the central hole, the straw assembly having a vent plug configured to seal the air vent when the straw assembly is in the closed position and to unseal the air vent when the straw assembly is in the open position.

7. The lid of claim 1, wherein the slidable lid cover includes a first magnet and the lid body includes a second magnet positioned proximate the rear side of the channel, the first and second magnets being arranged to magnetically bias the slidable lid cover toward the open position.

8. The lid of claim 1, wherein the straw assembly comprises a spout oriented to extend through the central hole when in the upward position, and further includes a straw support structure configured to align with a removable straw coupled to the bottom side of the lid body.

9. A lid for a beverage container, comprising:

a lid body having a top side and a bottom side;

a channel on the top side extending between a front side and a rear side of the lid body;

a slidable lid cover positioned within the channel and movable between a closed position and an open position;

a first magnet disposed on the slidable lid cover and a second magnet disposed on the lid body proximate the rear side of the lid body, the first and second magnets configured to magnetically bias the slidable lid cover toward the open position;

a cavity disposed beneath the channel and extending from the front side of the lid body to at least a central hole; and a straw assembly disposed within the cavity, the straw assembly comprising at least one biasing member configured to urge the straw assembly upward into alignment with the central hole as the slidable lid cover moves to the open position.

10. The lid of claim 9, wherein the lid body comprises a stop feature configured to maintain an orientation of a straw attachment interface at approximately 90 degrees relative to the lid body when a removable straw is detached.

11. The lid of claim 9, wherein the first and second magnets are arranged to generate a net attractive force that urges the slidable lid cover from the closed position to the open position.

12. The lid of claim 9, wherein the channel is recessed into the top side of the lid body, and the slidable lid cover is flush with the top side when in the closed position.

13. The lid of claim 9, wherein the lid body includes a travel stop feature located adjacent to the rear side of the channel to limit movement of the slidable lid cover beyond the open position.

14. The lid of claim 9, further comprising:

a cavity beneath the channel and a straw assembly disposed within the cavity.

15. The lid of claim 14, wherein the straw assembly is configured to pivot upward into alignment with a central hole in the lid body when the slidable lid cover is in the open position.

16. The lid of claim 15, wherein the straw assembly is coupled to at least one biasing member configured to urge the straw assembly toward an upward position.

17. The lid of claim 15, further comprising:

an air vent in the cavity and a vent plug coupled to the straw assembly, the vent plug sealing the air vent when the straw assembly is stowed and unsealing the air vent when the straw assembly is aligned with the central hole.

18. The lid of claim 15, further comprising:

a removable straw coupled to the bottom side of the lid body and in fluid communication with the straw assembly when in alignment with the central hole.

* * * * *